US006157008A

United States Patent [19]

Brown et al.

[11] Patent Number: 6,157,008

[45] Date of Patent: Dec. 5, 2000

[54] POWER DISTRIBUTION SYSTEM FOR AN APPLIANCE

[75] Inventors: John Scott Brown, Charleston; Anthony E. Kendall, Ooltewah, both of Tenn.

[73] Assignee: Maytag Corporation, Newton, Iowa

[21] Appl. No.: 09/349,075

[22] Filed: Jul. 8, 1999

[51] Int. Cl.[7] ..... H05B 1/02

[52] U.S. Cl. ..... 219/486; 219/508; 219/394; 219/412; 219/480

[58] Field of Search ..... 219/485, 486, 219/508, 487, 394, 398, 414, 446.1, 480, 412; 307/39, 41, 35, 38

[56] References Cited

U.S. PATENT DOCUMENTS

| | | | |
|---|---|---|---|
| 2,843,759 | 7/1958 | Roots | 307/38 |
| 3,005,109 | 10/1961 | Funkhouser et al. | 219/485 |
| 4,066,913 | 1/1978 | Manning et al. | 307/38 |
| 4,160,153 | 7/1979 | Melander | 219/485 |
| 4,419,589 | 12/1983 | Ross | 307/39 |
| 4,472,640 | 9/1984 | Elmer | 307/35 |
| 4,659,943 | 4/1987 | Virant | 307/39 |
| 4,687,948 | 8/1987 | Helt | 307/38 |
| 4,695,738 | 9/1987 | Wilmot | 307/31 |
| 5,191,191 | 3/1993 | Aubyn | 219/485 |
| 5,280,157 | 1/1994 | Hornung . | |
| 5,521,359 | 5/1996 | Bone | 307/38 |

FOREIGN PATENT DOCUMENTS

| | | | |
|---|---|---|---|
| 163915 | 12/1985 | European Pat. Off. . | |
| 2443294 | 3/1976 | Germany | 219/485 |
| 7-193970 | 7/1995 | Japan . | |
| 8-130826 | 5/1996 | Japan . | |
| 2324662 | 10/1998 | United Kingdom . | |

*Primary Examiner*—John A. Jeffery
*Attorney, Agent, or Firm*—Everett G. Diederiks, Jr.

[57] ABSTRACT

An appliance includes a plurality of electric power consuming devices having associated activated power consumption levels which collectively can exceed an available power supply limit to the appliance. The appliance includes a control system for power distributing to the various devices in a manner which optimizes performance while preventing the current draw from exceeding the established limit. In the most preferred embodiment, the appliance constitutes a range having various heating components, preferably first and second ovens, as well as a plurality of surface heating elements. A current monitoring arrangement signals demanded current levels from certain ones of the heating components, with the signals being used by the control system to distribute the available current on a predetermined priority basis.

11 Claims, 2 Drawing Sheets

POWER DISTRIBUTION SYSTEM FOR AN APPLIANCE

BACKGROUND OF THE INVENTION

1. Field of the Invention

The present invention pertains to the art of appliances and, more particularly, to a system for distributing power to various electrical devices of an appliance when the potential power consumption level of the devices collectively exceeds the available supply to the appliance.

2. Discussion of the Prior Art

There exist different types of appliances which incorporate various electrical devices that can be activated individually or simultaneously. For example, a typical electric household range includes an oven and generally four surface heating elements. Once the appliance is connected within a household, there will be a preset power supply limit available for use by the appliance. In most instances, there exist building codes which must be adhered to in wiring for such an appliance such that the available power supply is typically pre-established.

With the above in mind, these types of appliances; are designed and manufactured utilizing electrical devices which have associated power consumption levels that do not collectively exceed the available power supply to the appliance. In this manner, it is assured that all of the power consumption devices can be simultaneously activated without overloading the electrical circuitry and blowing a fuse. However, from a practical standpoint, it is actually quite rare that all of the electrical devices will require activation at the same time.

Certainly, some versatility and other benefits can be made available to the consumer if the appliance were to incorporate either additional electrical devices or higher powered devices, even if these devices were to collectively exceed the available power supply limit if simultaneously activated. For instance, in the case of an electric household range, it may be advantageous to increase the available upper operating temperatures for the oven and/or the surface burners, or to even incorporate a second oven unit as part of the overall range. Without correspondingly decreasing the power rating of the individual components to safeguard against a system overload, these design changes are typically not available.

Based on the above, there exists a need in the art of electrical appliances for a control system which can be used to effectively distribute power to multiple power consumption devices of an appliance when the collective power consumption level of the devices exceeds the overall power supply limit available to the appliance. Such a power distributing system will enable product lines to be expanded to include appliances having more versatile features for the consumer, without requiring changes to standard power supply line designs for the appliances.

SUMMARY OF THE INVENTION

The present invention pertains to a system for distributing power supplied to an appliance incorporating multiple electrical devices that, if actuated simultaneously, could exceed the available power supply limit to the appliance. More specifically, the invention concern an appliance including a plurality of electric power consuming devices having associated activated power consumption levels which collectively can exceed an available power supply limit to the appliance. The appliance includes a control system for power distributing to the various devices in a manner which optimizes performance while preventing the current draw from exceeding an established limit.

In one embodiment of the invention, the appliance constitutes a cooking unit having various heating components, preferably first and second ovens, as well as a plurality of surface heating elements. A current monitoring arrangement is provided to signal demanded current levels from certain ones of the heating components, with the signals being used by the control system to distribute the available current on a predetermined priority basis. In accordance with the most preferred form of the invention, the control system includes current sensors electrically interposed between the power distributing unit and the first and second ovens, with sensed current values being fed back to the power distributing unit.

Additional objects, features and advantages of the present invention will become more readily apparent from the following detailed description of a preferred embodiment wherein like reference numerals refer to corresponding parts in the several views.

DETAILED DESCRIPTION OF THE PREFERRED EMBODIMENT

Figure 1:
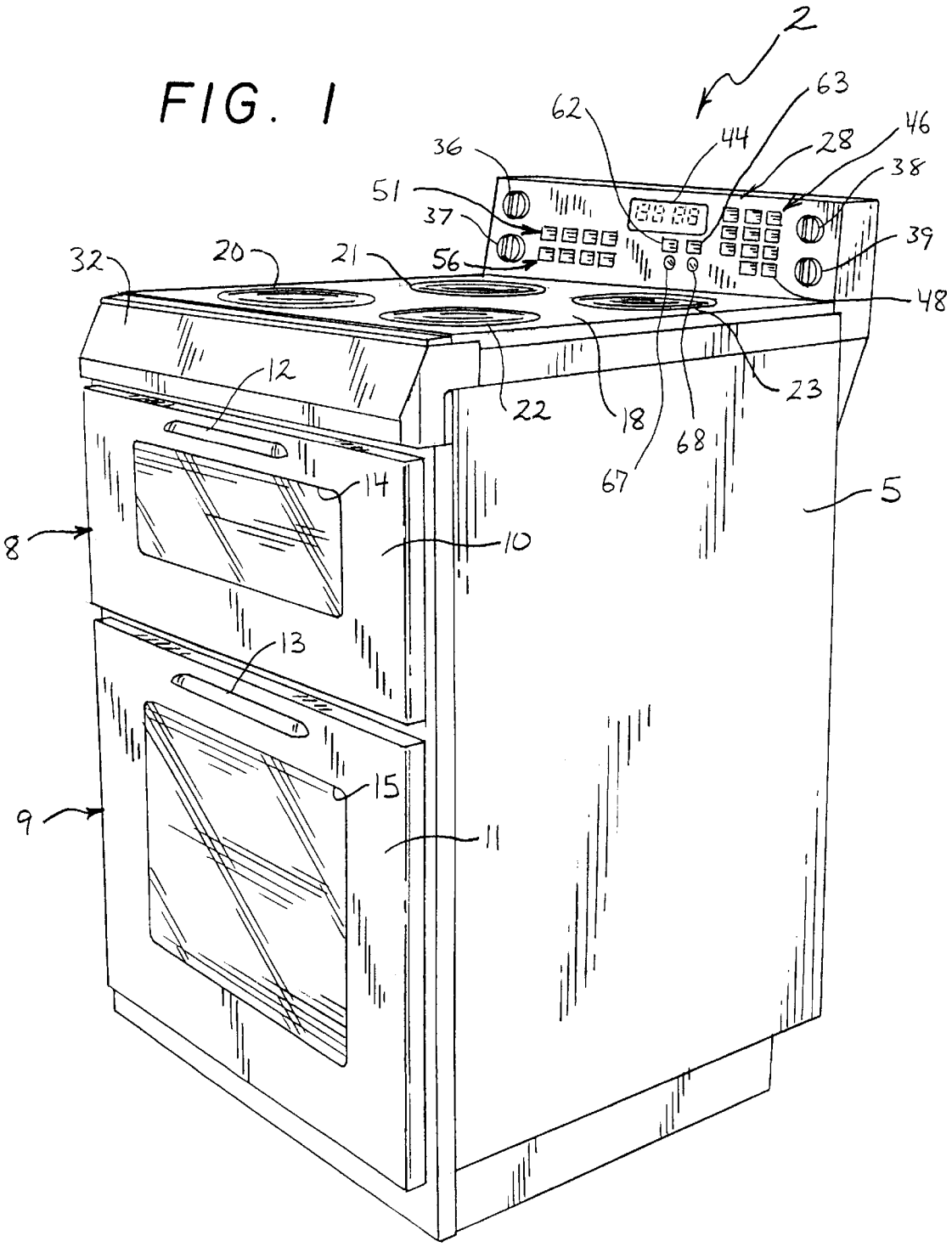
FIG. 1 is a perspective view of an electric range incorporating the power distributing control system of the present invention.

With initial reference to FIG. 1, the invention is illustrated for use in connection with an electric range generally indicated at 2. In the embodiment shown, electric range 2 includes a cabinet, within which is arranged a first or upper oven 8 and a second or lower oven 9. Upper and lower ovens 8 and 9 have associated doors 10 and 11 which are respectively provided with handles 12 and 13 that can be used to pivot doors 10 and 11 in order to access respective cooking chambers of ovens 8 and 9. For the sake of completeness, this figure illustrates doors 10 and 11 with respective viewing windows 14 and 15.

Cabinet 5 is also provided with an associated range top 18 which supports various spaced surface heating elements 20–23 in a manner known in the art. At an upper rear portion, cabinet 5 is provided a control panel 28. At this point, it should be realized that the location of control panel 28 could vary in accordance with the present invention. For example, control panel 28 could be located along an upper face panel 32 of cabinet 5. In any event, control panel 28 includes a plurality of knobs 36–39 for use in selectively activating and deactivating surface heating elements 20–23 respectively. In addition, control panel 28 is shown to include a central display 44, such as an LED or LCD display unit. Furthermore, control panel 28 is provided with a number pad generally S indicated at 46 that has an associated button 48 for clearing inputted data by the consumer.

Although the particular features incorporated into electric range 2 could vary greatly within the scope of the present invention, for the sake of completeness in describing a preferred form of the invention, control panel 28 of range 2 is also shown to include an upper row of control buttons generally indicated at 51 which are provided to select the operational mode for upper oven 8. For instance, the row of control buttons 51 can be used to select bake, broil, clean and o ff modes for upper oven 8. In a similar manner, a lower row of control buttons 56 is provided to control lower oven 9. In the most preferred form of the invention, it is preferred to enable the user to program the operation of at least upper and lower ovens 8 and 9 through the use of the upper and lower rows of control buttons 51 and 56 and numeric pad 46, as well as timer buttons 62 and 63 for the upper and lower ovens 8 and 9 respectively. Furthermore, for the sake of completeness., buttons 67 and 68 are provided to enable a consumer to selectively activate lights provided in upper and lower ovens 8 and 9, with the lights being usable in combination with windows 14 and 15 to view the progress of a cooking operation.

Figure 2:
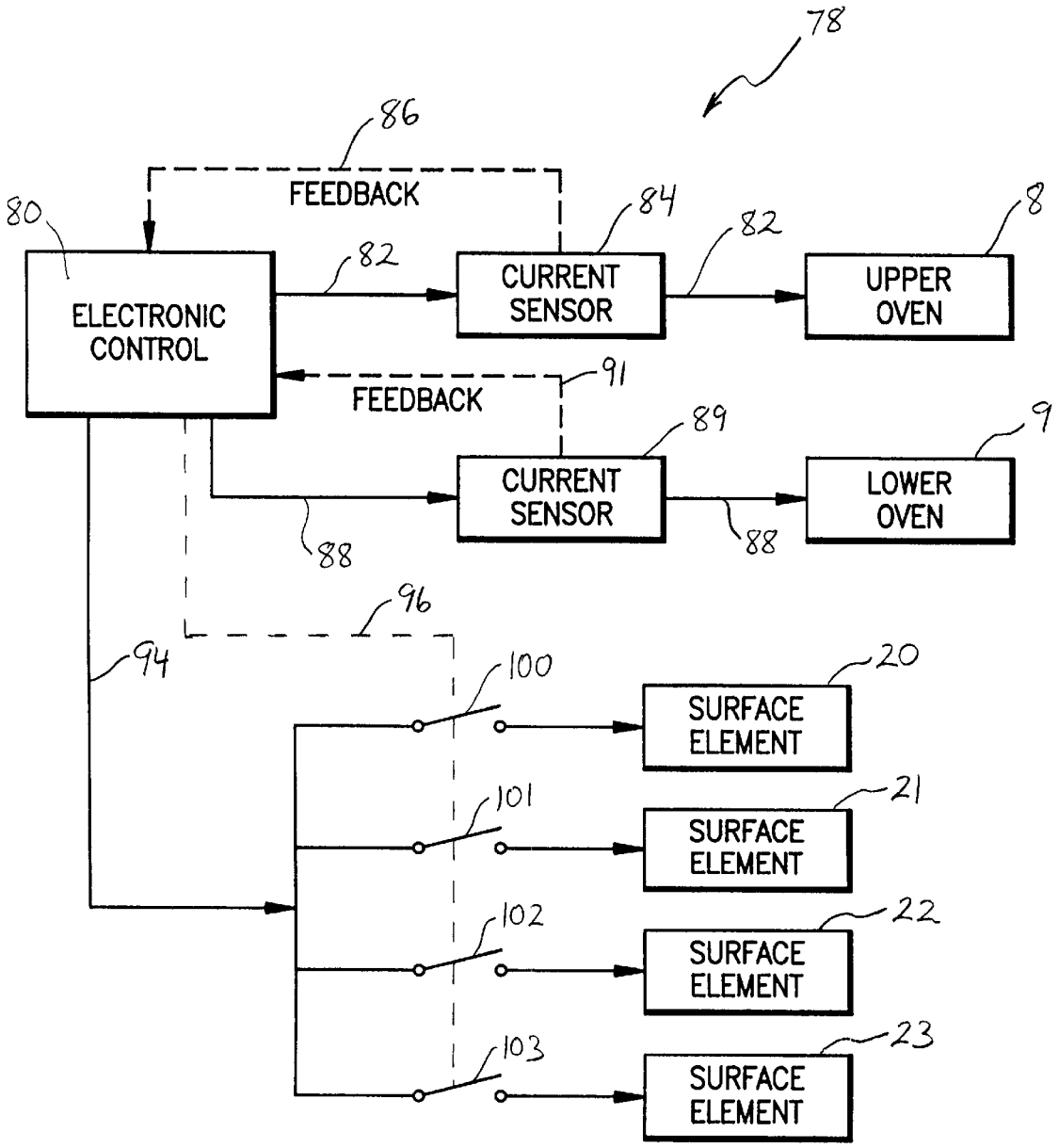
FIG. 2 is a schematic view of the power distributing control system according to a preferred embodiment of the invention.

In using range 2, it may be quite rare that all of the electrical devices, i.e., upper and lower ovens 8 and 9 and surface heating elements 20–23, would be activated simultaneously. More typically, certain combinations of these power consuming devices would likely be activated. A more common range available on the market would only incorporate a single oven for use in combination with surface heating elements. However, both the upper and lower ovens 8 and 9 are provided in accordance with the present invention even though, if upper and lower ovens 8 and 9 are simultaneously activated in combination with a predetermined number of the surface heating elements 20–23, the required operational power could exceed the available power supply limit available to electric range 2. Instead of limiting the versatility of the range design, the present invention provides a full range of operation for both ovens 8 and 9, as well as surface heating elements 20–23, by incorporating a power distributing control system to prevent the occurrence of any overload condition, even when ovens 8 and 9 and surface heating elements 20–23 are used in a manner which would demand more power than is available to range 2. More particularly, the control system incorporated into range 2 operates to deliver power to activated ones of the power consuming devices on a priority basis when the power consumption levels of the power consuming devices would collectively exceed the available power supply limit. Reference will now be made to FIG. 2 in describing a preferred embodiment of the control system which is generally indicated at 78.

As shown in this figure, control system 78 includes an electronic controller 80 that forms part of control panel 28. Electronic control 80 functions to distribute power to the power consuming devices of range 2 as represented in the presented embodiment by upper oven 8, lower oven 9 and surface heating elements 20-23. For this purpose, electronic control 80 has a first power distribution line 82 that leads to upper oven 8. Interposed between upper oven 8 and electronic control 80 is a first current sensor 84. Sensor 84 monitors the required current of upper oven 8 based on established settings at control panel 8 by the consumer.

Signals from current sensor 84 are directed to electronic control 80 through feedback loop 86. A second power distribution line 88 is directed from electronic control 80 to lower oven 9. A second current sensor 89 is arranged in a manner similar to first current sensor 84 in order to monitor the demanded current by lower oven 9 and to signal electronic control 80 through a feedback loop 91. Electronic control 80 also includes a third power distribution line 94 which is bifurcated in order to deliver power to the various surface heating elements 20–23. Furthermore, electronic control 80 has associated therewith an output signal control line 96 that is connected to switches 100–103. Switches 100–104 are preferably constituted by electromechanical switches interposed between third power distribution line 94 and surface heating elements 20–23 respectively. By controlling the opening and closing of switches 100–103, electronic control 80 can regulate the ability of each of surface heating elements 20–23 to be activated by the consumer through knobs 36–39 respectively. Of course, as is well known in the art, control knobs 36–39 would be used to select the heating level achieved by the respective surface heating elements 20–23, generally between low, medium and high setting positions. However, these consumer settings could only be established if electronic control 80 enables current to flow to the surface heating elements 20–23 by means of the switches 100–103.

In accordance with the invention, if a consumer activates selected ones of the upper and lower ovens 8 and 9 and/or surface heating elements 20–23 and establishes heating levels having associated current draws for the various power consuming devices which do not exceed the available power supply limit to range 2, electronic control 80 simply provides the demanded current through the respective first, second and/or third power distribution lines 82, 84 and 94 and assures that each of switches 100–103 are closed. However, should the consumer operate range 2 in a manner wherein the collective power consumption level would exceed the available power supply limit, electronic control 80 would operate in a preset manner to distribute the available power supply to certain ones of the power consuming devices. In the most preferred form of the invention, electronic control 80 would give First priority to upper oven 8, followed by priority to lower oven 9 and then finally to the surface elements 20–23. In addition, the most preferred form of the invention utilizes a last on/first off strategy for the surface heating elements 20–23 through the positioning of switches 100–103.

As indicated above, the most preferred form of the invention incorporates first and second current sensors 84 and 89 which monitor the current required by upper and lower ovens 8 and 9 respectively. Therefore, electronic control 80 receives signals related to a power consumption operating parameter and utilizes these signals to determine the necessity to distribute power on the predetermined priority basis. Although current sensors are utilized in the most preferred form of the invention, other power consumption related operating parameters could be sensed, such as variations in voltage or resistance levels. Furthermore, an additional sensor could be provided in connection with surface elements 20–23. However, given the priority preestablished in accordance with the preferred embodiment of the invention, such an additional sensor merely adds to the associated cost and is not deemed necessary.

In general, it should be realized that various changes and/or modifications can be made to the present invention without departing from the spirit thereof. For instance, although the appliance disclosed in the preferred embodiment of the invention represents a cooking unit in the form of a range having upper and lower ovens and a plurality of surface burners, the power distribution control system can be utilized in connection with various types of appliances. For instance, in cooking units alone, wall mounted double oven units, ranges having associated microwaves, and the like could be made equally applicable. Therefore, the invention has applicability to various types of appliances that include multiple power consuming devices which can be activated simultaneously and wherein the power consuming devices have activated power consumption levels that can collectively exceed an available power supply limit to the appliance. Under these circumstances, the appliance can incorporate the power distributing control system of the invention to assure that the current drawn by the appliance does not exceed a desired limit. In any event, the invention is only intended to be limited by the scope of the following claims.

We claim:

1. An electric cooking appliance having an available power supply limit comprising:

a first power consumption device having an associated first power consumption level, said first power consumption device constituting a first oven of the cooking appliance;

a second power consumption device having an associated second power consumption level, said second power consumption device constituting a second oven of the cooking appliance;

a third power consumption device having an associated third power consumption level, said third power consumption device constituting a plurality of surface heating elements of the cooking appliance, wherein the first, second and third power consumption levels collectively exceed the available supply limit;

a first sensor for monitoring a power consumption related operating parameter of the first power consumption device;

a second sensor for monitoring a power consumption related operating parameter of the second power consumption device; and an electronic controller for distributing power to activated ones of the first second and third power consumption devices based on signals received from at least one of said first and second sensors, said controller distributing power on a predetermined priority basis when a collective power consumption level of activated ones of the first, second and third power consumption devices would exceed the available supply limit.

2. The electric appliance according to claim 1, wherein the electronic controller prioritizes in the order of the first oven, followed by the second oven and finally the surface heating elements.

3. The electric appliance according to claim 2, wherein the electronic controller utilizes a last on/first off strategy in prioritizing the distribution of power to the plurality of surface heating elements.

4. The electric appliance according to claim 1, wherein each of the first and second sensors comprises a current sensor.

5. The electric appliance according to claim 1, wherein the first and second sensors monitor current levels required by the first ans second power consumption devices respectively.

6. The electric appliance according to claim 5, wherein each of the first and second sensors is interposed between the electronic controller and a respective one of the first and second ovens.

7. A method of distributing power to multiple power consumption devices, including a first oven, a second oven and a plurality of surface heating elements of a cooking appliance, which if actuated simultaneously, would collectively exceed the available power supply limit to the appliance comprising;

delivering a demanded power level to each of the activated one of said power consumption devices so long as a collective, demanded power level of the activated ones of said power consumption devices is below the available power supply limit;

individually monitoring a power consumption related operating parameter for each of a plurality of the multiple power consumption devices; and distributing power to the activated ones of said power consumption devices on a predetermined priority basis when the activated power consumption levels of the power consumption devices would exceed the available power supply limit.

8. The method according to claim 7, further comprising: monitoring the power consumption related operating parameter by sensing a demand current for each of the plurality of multiple power consumption devices.

9. The method according to claim 8, wherein the demand current sensing is performed for each of the first and second ovens.

10. The method according to claim 9, further comprising: prioritizing the power by delivering the available power initially to the first oven, then to the second oven and finally to selected ones of the plurality of surface heating elements.

11. The method according to claim 10, further comprising: utilizing a last on/first off strategy in prioritizing power delivered to the plurality of surface heating elements.

* * * * *